US009228335B2

(12) United States Patent
Quick et al.

(10) Patent No.: US 9,228,335 B2
(45) Date of Patent: Jan. 5, 2016

(54) ODOUR EXTRACTION DEVICE FOR A TOILET AND AN ASSOCIATED COLLAR

(71) Applicant: Geoffrey Charles Quick, New South Wales (AU)

(72) Inventors: Wes Quick, New South Wales (AU); Geoffrey Charles Quick, New South Wales (AU)

(73) Assignee: Geoffrey Charles Quick, New South Wales (AU)

( * ) Notice: Subject to any disclaimer, the term of this patent is extended or adjusted under 35 U.S.C. 154(b) by 226 days.

(21) Appl. No.: 14/096,854

(22) Filed: Dec. 4, 2013

(65) Prior Publication Data

US 2015/0107009 A1 Apr. 23, 2015

(30) Foreign Application Priority Data

Oct. 21, 2013 (AU) ..... 2013904045

(51) Int. Cl.
*E03D 9/05* (2006.01)
*E03D 9/052* (2006.01)

(52) U.S. Cl.
CPC . *E03D 9/05* (2013.01); *E03D 9/052* (2013.01)

(58) Field of Classification Search
USPC ..... 4/300–442, 209 R–29 FF
See application file for complete search history.

(56) References Cited

U.S. PATENT DOCUMENTS 2,923,012 A * 2/1960 Kohlmeyer ..... E03D 1/286 4/331
3,649,972 A * 3/1972 Sowards ..... E03D 9/052 4/211

* cited by examiner

*Primary Examiner* — Lori Baker
(74) *Attorney, Agent, or Firm* — Jansson Munger McKinley & Kirby Ltd.

(57) ABSTRACT

A toilet including: a toilet pan having an interior and a flushing outlet; a toilet cistern having an interior; a cistern overflow pipe in communication with the toilet-pan interior; a collar for connecting the flushing outlet to a sewer discharge pipe, the collar having a passage through it with exterior and interior ends; a fan within the cistern interior and having a fan inlet and a fan outlet; and a duct for gas communication from the fan outlet to the passage exterior end, the fan adapted to draw gas from within the toilet-pan interior through the overflow pipe and then propel it into the duct, through the passage and into the sewer discharge pipe.

16 Claims, 4 Drawing Sheets

12
14
10'
18c
18e

10"

ODOUR EXTRACTION DEVICE FOR A TOILET AND AN ASSOCIATED COLLAR

CROSS REFERENCE TO RELATED APPLICATION

This application claims priority based on Australian patent application AU2013904045 filed Oct. 21, 2013.

FIELD OF THE INVENTION

The present invention relates to an odour extraction device for a toilet and to a collar for use in odour extraction from a toilet.

The invention will be described herein for use in toilets in fixed homes. However, the invention is not limited to this particular use and is also applicable for use with toilets in other environments including marine vessels, mobile homes, campers, vans, recreational vehicles, caravans, portable buildings, portable toilets and similar facilities.

BACKGROUND OF THE INVENTION

The Applicant's international PCT patent application number PCT/AU2007/000003 (WO 2007/079524) discloses embodiments of an odour extraction device for a gravity flushing toilet pan. The disclosed odour extraction devices include a fail safe, one way valve to prevent unpleasant odours from flowing from the sewer back to the toilet pan. The disclosed odour extraction devices utilize a suction fan to draw gas from within the pan and expel it through a duct into the pan's flushing outlet pipe. The gas then flows through the pan's flushing outlet pipe into the sewer.

In order to retrofit the odour extraction device to an existing pan, a modification must be made to the pan's flushing outlet pipe to connect the duct thereto. Alternatively, a new pan can be made with a suitable connector for the duct formed therein. Both approaches add to the cost and complexity of the use of the odour extraction device.

Further, the use of odour extraction devices of the type disclosed in the above PCT application with a siphonic toilet have proven unsuccessful. This is due to the connection of the duct to some parts of the pan's flushing outlet pipe compromising the effectiveness of the siphonic flushing action.

It is an object of the present invention to substantially overcome or at least ameliorate one or more of the above disadvantages

SUMMARY OF THE INVENTION

Accordingly, in a first aspect, the present invention provides a toilet including a toilet pan, defining an interior, with a flushing outlet and a toilet cistern, defining an interior. A cistern overflow pipe is provided in fluid and gas communication with the toilet pan interior and a collar for connecting the pan flushing outlet to a sewer discharge pipe, the collar including a passage therethrough with an exterior end and an interior end. A means to provide suction is included, within the pan interior, having an inlet and an outlet and a duct for gas communication from the outlet of the suction means to the passage exterior end. The means providing suction is adapted to draw gas from within the toilet pan interior through the overflow pipe and then propel said gas into the duct, through the passage and into the sewer discharge pipe.

In one exemplary embodiment, the toilet is a gravity flushing toilet. In another exemplary embodiment, the toilet is a siphonic flushing toilet.

The collar preferably includes a body with the passage therein. The body preferably includes a first section for connecting to the sewer discharge pipe and a second section for connection to the pan flushing outlet. The first body section is preferably cylindrical and of relatively smaller diameter and the second body section is preferably cylindrical and of relatively larger diameter.

The passage preferably has an inlet end and an outlet end. The passage inlet end is preferably remote to the second body section and the outlet end is preferably an opening in the second body section.

The collar preferably has a length adjustable section adjacent the exterior end. The collar may also preferably include a gasket for substantially sealing the collar to the pan flushing outlet. The collar preferably includes a gasket retainer to retain the gasket adjacent the body. The gasket retainer is preferably mounted to the body.

In a second aspect, the present invention provides a collar for use in odour extraction from a toilet, the collar adapted for connecting between a toilet pan flushing outlet and a sewer discharge pipe. The collar may include a passage therethrough with an exterior end, connectable to a toilet odour source, and an interior end, in gas communication with the sewer discharge pipe.

In one exemplary embodiment, the toilet is a gravity flushing toilet. In another exemplary embodiment, the toilet is a siphonic flushing toilet. The collar preferably has a length adjustable section adjacent the exterior end.

The collar preferably includes a body with the passage therein, the body preferably includes a first section for connecting to the sewer discharge pipe and a second section for connection to the pan flushing outlet. The first body section is preferably cylindrical and of relatively smaller diameter and the second body section is preferably cylindrical and of relatively larger diameter.

The passage exterior end is preferably remote the body second section. The passage interior end is preferably an opening in the body second section.

The collar preferably includes a gasket for substantially sealing the collar to the pan flushing outlet. The collar preferably includes a gasket retainer to retain the gasket adjacent the body. The gasket retainer is preferably mounted to the body.

BRIEF DESCRIPTION OF THE DRAWINGS

Preferred embodiments of the present invention will now be described, by way of examples only, with reference to the accompanying drawings wherein.

DETAILED DESCRIPTION OF THE INVENTION

Figure 4:
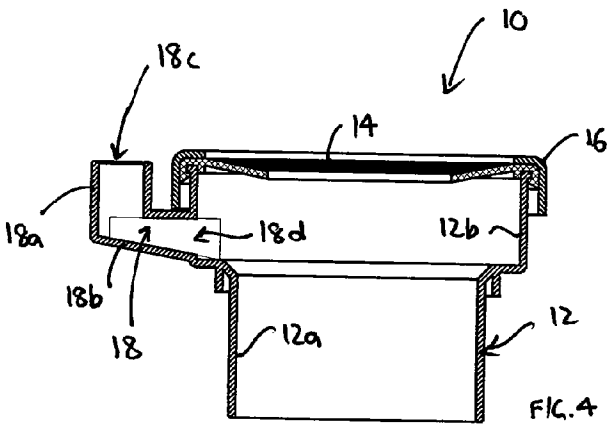
FIG. 4 is a cross sectional side view of the collar shown in FIG. 1.
Figure 5:
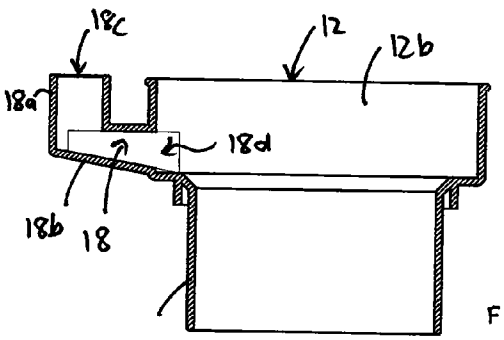
FIG. 5 is a cross sectional side view of a body of the collar shown in FIG. 1.
Figure 1:
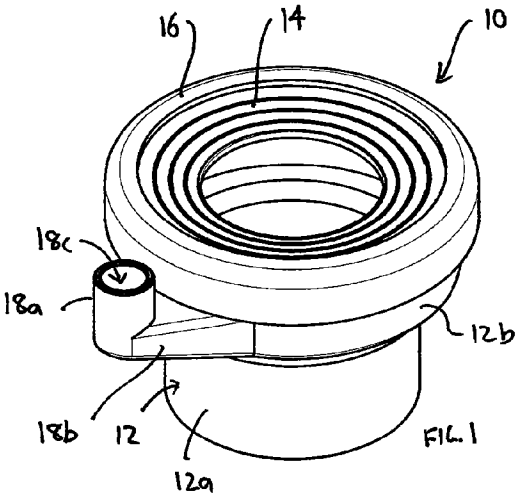
FIG. 1 is an upper perspective view of a first embodiment of a collar for use in odour extraction from a (gravity flushing) toilet.
Figure 2:
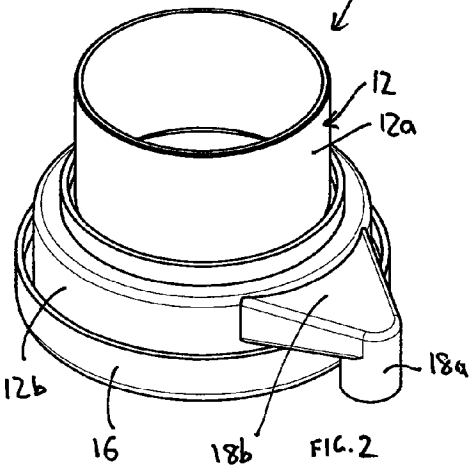
FIG. 2 is a lower perspective view of the collar shown in FIG. 1.
Figure 3:
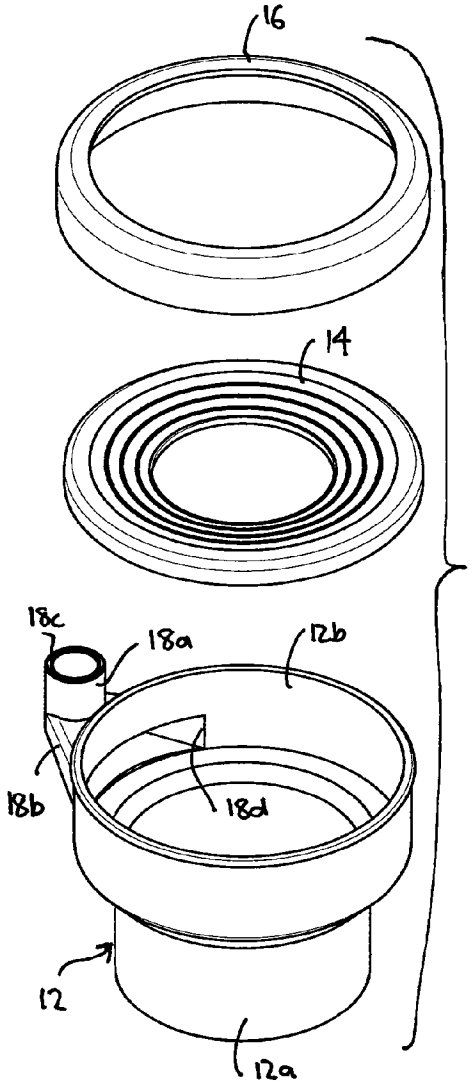
FIG. 3 is an exploded upper perspective view of the collar shown in FIG. 1.

FIGS. 1 to 5 show a first embodiment of a collar 10 used in odour extraction from a gravity flushing toilet. The collar 10 includes a hollow plastic body 12 formed from a cylindrical lower section 12*a* of relatively smaller diameter and a cylindrical upper section 12*b* of relatively larger diameter. The collar 10 also includes a rubber gasket 14 and a gasket retainer, in the form of a plastic cylindrical cap 16 which mounts to the upper section 12*b* of the body 12. The gasket 14 is adapted for sealing around the flushing outlet of a toilet, as will be described in more detail below.

The body 12 includes a passage 18 therethrough with a cylindrical inlet part 18*a* and a tapered outlet part 18*b*. The inlet part 18*a* includes an exterior end 18*c* of the passage 18 and the tapered part 18*b* includes an interior end 18*d* of the passage 18. The interior end 18*d* of the passage 18 is in the form of an opening in the upper section 12*b* of the body 12. The passage 18 allows gas to be communicated therethrough from the exterior end 18*c* to the interior end 18*d* and so into the interior of the body 12.

Figure 6:
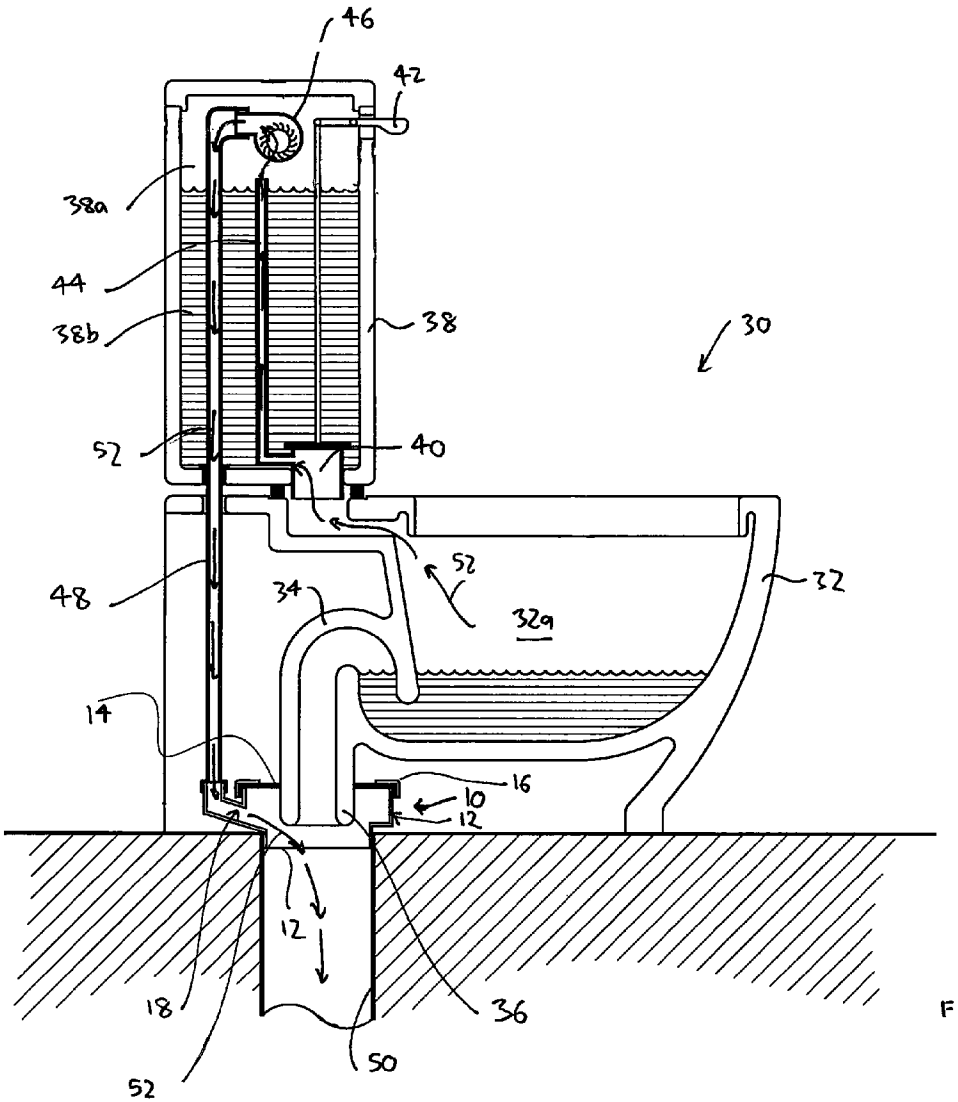
FIG. 6 is a cross sectional side view of a first embodiment of a siphonic toilet using the collar shown in FIG. 1.

FIG. 6 shows a first embodiment of a siphonic toilet 30 using the collar 10. The toilet 30 includes a toilet pan 32 with a U-bend trap 34 extending from an interior 32*a* of pan 32 to a flushing outlet pipe 36. The exterior of flushing outlet pipe 36 forms a substantially gas tight seal with gasket 14.

Toilet 30 also includes a cistern 38 having an interior 38*a* shown partially filled with flushing water 38*b*. Cistern 38 includes a flush mechanism, in the form of a valve 40 operated by a handle 42. An overflow pipe 44 provides gas and fluid communication between the interior 32*a* of pan 32 and interior 38*a* of cistern 38, via valve 40.

A suction means, in the form of an electrically powered fan 46, is installed within interior 38*a* of cistern 38. The fan 46 includes a failsafe, one way valve and is preferably of the type shown in the Applicant's previously mentioned international PCT patent application. A duct 48 provides gas communication from the outlet of the fan 46 to exterior end 18*c* of passage 18.

Cistern 30 is shown installed adjacent a sewer pipe 50. Collar 10 is connected to the sewer pipe 50 by virtue of lower section 12*a* of body 12 being snugly received within the upper end of sewer pipe 50.

In operation, fan 46 is energized to create suction within interior 38*a* of the cistern above the level of the water 38*b*. This suction causes gas odours to be drawn from interior 32*a* of pan 32 through valve 40, then through overflow pipe 44 into cistern interior 38*a*. The gas odours are then drawn through fan 46 and propelled through duct 48, then through passage 18 and finally into sewer pipe 50 for transport away from any user of toilet 30. The path of the gas odours from pan interior 32*a* to sewer pipe 50 is indicated by arrows 52.

Advantageously, as the gas is communicated to sewer pipe 50 downstream of flushing outlet 36, the operation of siphonic toilet 30 is not compromised. Further, collar 10 may be used with siphonic toilets without requiring any modification of toilet pan 32, and is thus also able to be retrofitted to existing siphonic toilets. Collar 10 is also able to be used with gravity flushing toilets without requiring any modification of the toilet pan, and is able to be retrofitted to existing gravity flushing toilets.

Figures 7A, 7B, 8A, 8B:
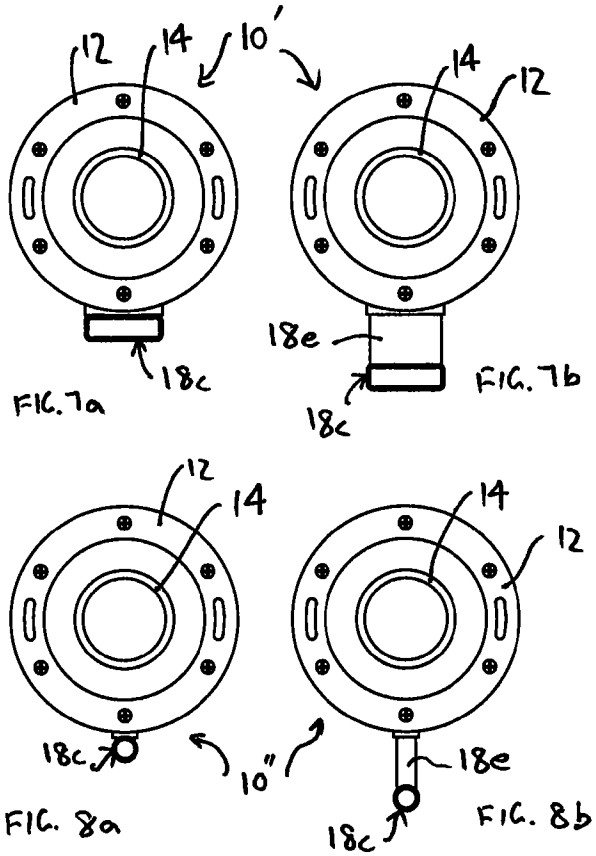
FIG. 7*a* is a top view of a second embodiment of a collar for use in odour extraction from a toilet, in a retracted position.
FIG. 7*b* is a top view of the collar shown in FIG. 7*a*, in an extended position.
FIG. 8*a* is an top view of a third embodiment of a collar for use in odour extraction from a toilet, in a retracted position.
FIG. 8*b* is a top view of the collar shown in FIG. 8*a*, in an extended position.

FIGS. 7*a* and 7*b* show a second embodiment of a collar 10' used in odour extraction from a toilet. Collar 10' is similar to the collar 10 described with reference to FIGS. 1 to 5 and like features have been indicated by like reference numerals In FIGS. 7 to 9. However, collar 10' includes a length adjustable section, in the form of a telescoping passage part 18*e*, adjacent exterior end 18*c* of passage 18. Telescoping passage part 18*e* allows the position of exterior end 18*c* to be adjusted between a retracted position (see FIG. 7*a*), relatively near to body 12 of collar 10', and an extended position (see FIG. 7*b*), where the exterior end is further away from body 12 of the collar 10'. Also, passage 18 of collar 10' has a rectangular cross section.

FIGS. 8*a* and 8*b* show a third embodiment of a collar 10" used in odour extraction from a toilet. Collar 10" is similar to the collar 10' shown in FIGS. 7*a* and 7*b* and like reference numerals have been indicated with like features. However, in collar 10", the passage 18 has a round cross section.

Figure 9:
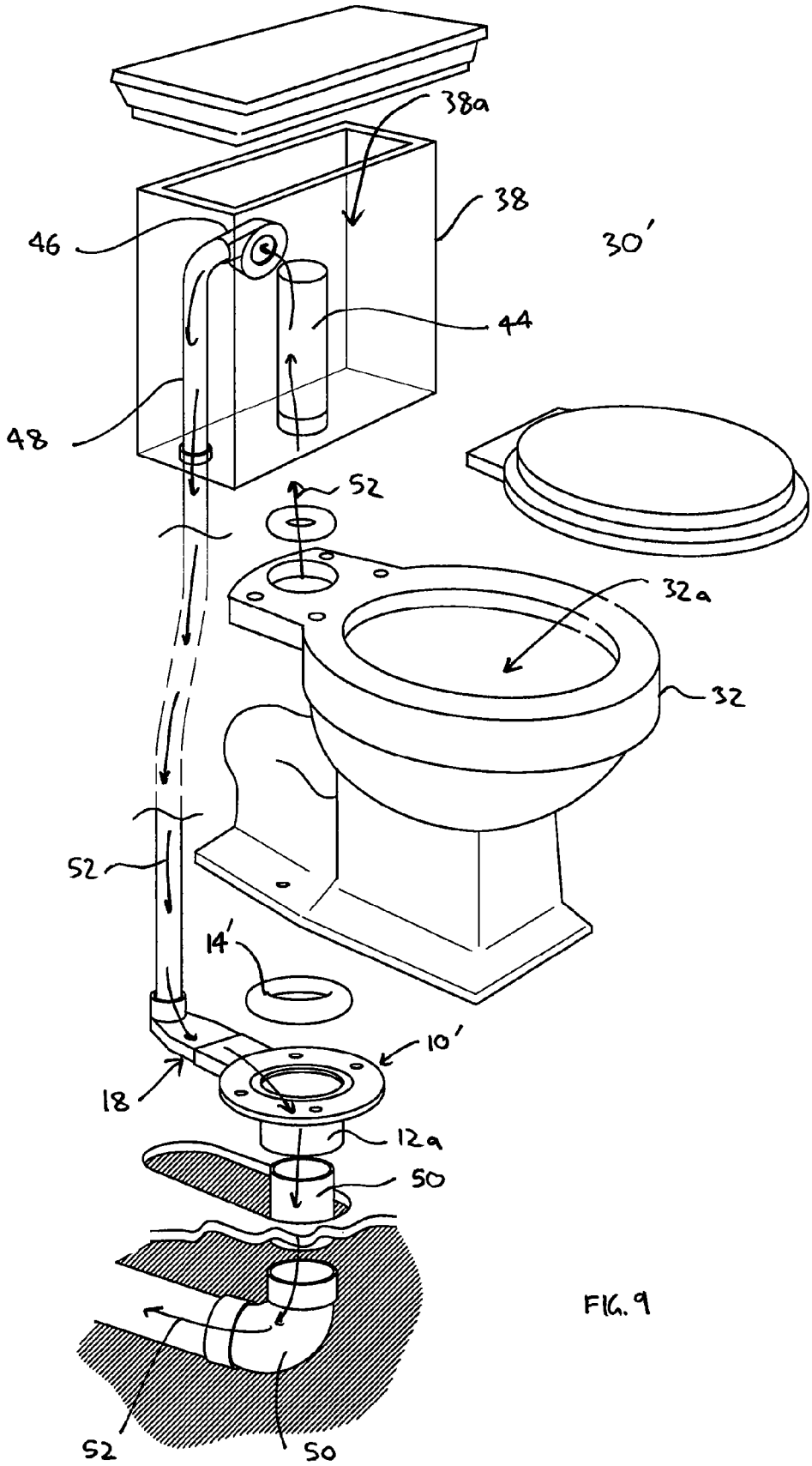
FIG. 9 is an exploded perspective view of a second embodiment of a (siphonic flushing) toilet using the collar shown in FIGS. 8*a* and 8*b*.

FIG. 9 shows a second embodiment of a siphonic toilet 30' in which like features to those shown in FIG. 6 have been indicated with like reference numerals. Toilet 30' uses collar 10' with a wax gasket 14' positioned between the bottom of flushing outlet pipe 34 and top of the body 12 of collar 10'. The operation of toilet 30' and collar 10' in odour extraction is the same as that previously described.

Reference throughout this specification to "the embodiment," "this embodiment," "the previous embodiment," "one embodiment," "an embodiment," "a preferred embodiment" "another preferred embodiment," "example," or similar language means that a particular feature, structure, or characteristic described in connection with the embodiment is included in at least one embodiment of the present invention. Thus, appearances of the phrases "in the embodiment," "in this embodiment," "in the previous embodiment," "in one embodiment," "in an embodiment," "in a preferred embodiment," "in another preferred embodiment," "in an example," "in the example" and similar language throughout this specification may, but do not necessarily, all refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

While the present invention has been described in connection with certain exemplary or specific embodiments, it should be understood that the invention is not limited to the disclosed embodiments, but, on the contrary, is intended to cover various modifications, alternatives, modifications and equivalent arrangements as will be apparent to those skilled in the art. Any such changes, modifications, alternatives, modifications, equivalents and the like may be made without departing from the spirit and scope of the invention.

What is claimed is:

1. A toilet including:

a toilet pan defining a toilet-pan interior and having a flushing outlet;

a toilet cistern defining a cistern interior;

a cistern overflow pipe in fluid and gas communication with the toilet-pan interior;

a collar for connecting the pan flushing outlet to a sewer discharge pipe, the collar including a passage therethrough with an exterior end and an interior end;

a fan within the cistern interior and having a fan inlet and a fan outlet; and a duct for gas communication from the fan outlet to the passage exterior end, wherein the fan is adapted to draw gas from within the toilet-pan interior through the overflow pipe and then propel said gas into the duct, through the passage and into the sewer discharge pipe.

2. The toilet as claimed in claim 1 wherein the toilet is a gravity flushing toilet.

3. The toilet as claimed in claim 1 wherein the toilet is a siphonic flushing toilet.

4. The toilet as claimed in claim 1 wherein the collar has a length adjustable section adjacent the exterior end.

5. The toilet as claimed in claim 1 wherein the collar includes a gasket for substantially sealing the collar to the pan flushing outlet.

6. The toilet as claimed in claim 5 wherein the collar includes a gasket retainer to retain the gasket adjacent the body.

7. The toilet as claimed in claim 6 wherein the gasket retainer is mounted to the body.

8. The toilet of claim 1 wherein the collar includes a body with the passage therein.

9. The toilet of claim 8 wherein the body includes a first section for connecting to the sewer discharge pipe and a second section for connection to the pan flushing outlet.

10. The toilet as claimed in claim 9 wherein the body first section is cylindrical and of relatively smaller diameter and the body second section is cylindrical and of relatively larger diameter.

11. The toilet of claim 10 wherein the passage has an inlet end and an outlet end, the passage inlet end being remote from the body second section and the outlet end being an opening in the body second section.

12. A collar for use in odour extraction from a toilet, the collar adapted for connecting between a toilet pan flushing outlet and a sewer discharge pipe, the collar including a body defining a passage therethrough which has an exterior end connectable to a toilet odour source and an interior end in gas communication with the sewer discharge pipe, the body including a first cylindrical section for connecting to the sewer discharge pipe and a second cylindrical section to the pan flushing outlet, the cylindrical second section being of relatively larger diameter than that of the first cylindrical section, the exterior end of the passage being remote from the second section of the body and the interior end of the passage being an opening in the second section of the body.

13. The collar as claimed in claim 12 wherein the toilet is a gravity flushing toilet.

14. The collar as claimed in claim 12 the toilet is a siphonic flushing toilet.

15. The collar as claimed in claim 12 wherein the collar has a length adjustable section adjacent the exterior end.

16. The collar as claimed in claim 12 wherein the collar includes a gasket for substantially sealing the collar to the pan flushing outlet.

* * * * *